United States Patent [19]

Proud et al.

[11] 4,247,800

[45] Jan. 27, 1981

[54] RADIOACTIVE STARTING AIDS FOR ELECTRODELESS LIGHT SOURCES

[75] Inventors: Joseph M. Proud, Wellesley; Robert J. Regan, Needham; Paul O. Haugsjaa, Acton; Donald H. Baird, Waban, all of Mass.

[73] Assignee: GTE Laboratories Incorporated, Waltham, Mass.

[21] Appl. No.: 8,807

[22] Filed: Feb. 2, 1979

[51] Int. Cl.[3] ..... H05B 41/233; H01J 7/40; H01J 65/06

[52] U.S. Cl. ..... 315/39; 315/248; 313/54

[58] Field of Search ..... 313/54; 315/39, 248

[56] References Cited

U.S. PATENT DOCUMENTS

| | | | |
|---|---|---|---|
| 750,889 | 2/1904 | Potter | 313/54 |
| 1,651,308 | 11/1927 | Winkelmann | 313/54 |
| 2,953,684 | 9/1960 | MacHutchin et al. | 313/54 X |
| 3,109,960 | 11/1963 | Bell et al. | 315/248 |
| 3,110,834 | 11/1963 | Schneider et al. | 313/54 |
| 3,648,100 | 3/1972 | Goldie et al. | 315/39 |
| 3,705,319 | 12/1972 | Goldie et al. | 313/54 |
| 3,787,705 | 1/1974 | Bolin et al. | 315/248 |
| 3,870,888 | 3/1975 | Lovelock | 313/54 X |
| 3,942,058 | 3/1976 | Haugsjaa et al. | 315/39 X |
| 3,942,068 | 3/1976 | Haugsjaa et al. | 315/39 |
| 3,943,401 | 3/1976 | Haugsjaa et al. | 315/39 |
| 3,943,402 | 3/1976 | Haugsjaa et al. | 315/39 |
| 3,943,403 | 3/1976 | Haugsjaa et al. | 315/39 |
| 3,943,404 | 3/1976 | McNeil et al. | 315/39 |
| 3,993,927 | 11/1976 | Haugsjaa et al. | 315/39 |
| 3,995,195 | 11/1976 | Haugsjaa et al. | 315/248 X |
| 3,997,816 | 12/1976 | Haugsjaa et al. | 315/267 |
| 4,001,631 | 1/1977 | McNeil et al. | 315/39 |
| 4,001,632 | 1/1977 | Haugsjaa et al. | 315/39 |
| 4,002,943 | 1/1977 | Regan et al. | 315/39 |
| 4,002,944 | 1/1977 | McNeil et al. | 315/39 |
| 4,041,352 | 8/1977 | McNeil et al. | 315/248 |
| 4,051,376 | 9/1977 | Lorch et al. | 313/54 X |
| 4,053,814 | 10/1977 | Regan et al. | 315/248 |
| 4,065,701 | 12/1977 | Haugsjaa et al. | 315/248 |
| 4,070,603 | 1/1978 | Regan et al. | 315/248 |

*Primary Examiner*—Alfred E. Smith
*Assistant Examiner*—Charles F. Roberts
*Attorney, Agent, or Firm*—William R. McClellan

[57] ABSTRACT

Radioactive materials are used to assist in starting a discharge in an electrodeless light source. The radioactive emissions predispose on the inner surface of the lamp envelope loosely bound charges which thereafter assist in initiating discharge. The radioactive material can be enclosed within the lamp envelope in gaseous or non-gaseous form. Preferred materials are krypton 85 and americium 241. In addition, the radioactive material can be dispersed in the lamp envelope material or can be a pellet imbedded in the envelope material. Finally, the radioactive material can be located in the termination fixture. Sources of alpha particles, beta particles, or gamma rays are suitable. Because charges accumulate with time on the inner surface of the lamp envelope, activity levels as low as $10^{-8}$ curie are effective as starting aids.

19 Claims, 7 Drawing Figures

RADIOACTIVE STARTING AIDS FOR ELECTRODELESS LIGHT SOURCES

BACKGROUND OF THE INVENTION

This invention relates to electrodeless light sources driven by high frequency power sources and, more particularly, to the use of radioactive materials to aid in the starting of electrodeless light sources.

Electrodeless light sources which operate by coupling high frequency power to an arc discharge in an electrodeless lamp have been developed. These light sources typically include a high frequency power source connected to a termination fixture with an inner conductor and an outer conductor disposed around the inner conductor. The electrodeless lamp is positioned at the end of the inner conductor. High frequency power is coupled to a light emitting electromagnetic discharge in the electrodeless lamp. A portion of the termination fixture passes radiation at visible light frequencies, thus permitting use of the apparatus as a light source.

The electrodeless lamp in its operating condition represents a relatively low impedance of approximately a few hundred ohms. However, in the off state the impedance of the lamp is high. Since the termination fixture is designed to effect an impedance match to the operating impedance of the lamp, thus obtaining maximum transfer of power from the source to the arc discharge, there exists in the off state a mismatch between the lamp and the high frequency power source. This off-state mismatch creates a problem in starting a discharge when power is first applied to the light source. In the mismatched condition, the electric field in the lamp may be insufficient to cause starting. A tuning element located in the termination fixture is used for starting in U.S. Pat. No. 4,002,944 issued Jan. 11, 1977 to McNeill et al. A resonant condition is created which causes a strong electric field to initiate breakdown and excitation of the fill material within the lamp.

The use of ultraviolet light sources to start the discharge in electrodeless lamps is described in U.S. Pat. No. 3,997,816 issued Dec. 14, 1976 to Haugsjaa et al. An ultraviolet source illuminates the electrodeless lamp and, in combination with a high frequency electric field from the power source, induces starting of the electrodeless lamp. The function of the ultraviolet flux is to predispose loosely bound charges upon the inner surface of the lamp or free charges in the gas contained in the lamp envelope. The charges are then available to be acted upon by the applied high frequency field so that collisional ionization and breakdown ensue, thus initiating discharge. Either a glow lamp or a spark generating device is located in the space between the inner and outer conductors of the termination fixture. Ultraviolet light sources were also utilized in electrodeless light source starting systems in U.S. Pat. No. 4,041,352 issued Aug. 9, 1977 to McNeill et al. and in U.S. Pat. No. 4,053,814 issued Oct. 11, 1977 to Regan et al. R. J. Regan, "Electrodeless Light Source with Self-Contained Excitation Source", Ser. No. 952,765, filed Oct. 19, 1978 and assigned to the same assignee as the present invention, describes a self-contained ultraviolet starting aid for electrodeless light sources.

While ultraviolet starting aids give generally satisfactory results, they have certain disadvantages. The ultraviolet source is normally used in conjunction with circuitry which operates to remove power from the ultraviolet source after electrodeless lamp starting has occurred. Both the ultraviolet source and its associated circuitry add complexity to the light source and result in increased cost and lower reliability.

Ionizing nuclear radiations, derived from various isotopes of the elements, may be used to result in the same effects produced by ultraviolet radiation to assist starting of electrodeless light sources. The dominant radioactive emissions associated with the natural decay of the radioactive elements are beta particles, alpha particles, and gamma rays. Each type of radioactive emission has unique properties which determine how it can be used in the present invention.

gamma rays are energetic photons, as is well known, and are the most penetrating of the three emanations. Such rays typically possess energy in the 0.04 to 1 MEV range and penetrate materials such as aluminum from approximately 1 to 10 cm, respectively. Energy loss occurs largely by photoelectric effect as gamma rays are absorbed in matter so that ionized and excited atoms and molecules are left in the absorption path.

Beta particles are energetic electrons which possess, typically, energy in a range similar to that cited for gamma rays. However, beta particles are much less penetrating, ranging from 0.001 cm to 0.1 cm in aluminum for energies between 0.04 to 1 MEV, respectively. Their adsorption in matter results in ionized and excited atoms and molecules by collisional processes.

Alpha particles are helium nuclei which are typically emitted with energies in the several MEV range. Their range in matter is much less than that of either gamma rays or beta particles. In aluminum, for example, alpha particles penetrate less than 0.001 cm and only a few centimeters in air at standard conditions. Penetration of lamp envelope material will be similar to that cited for aluminum in each case above.

The prior art contains examples of the use of radioactive materials in gaseous discharge devices for the purpose of rapid initiation of breakdown in the gas. In all known prior art, it is the purpose of the initiating aid to yield a very short time interval between application of the driving field and breakdown in the gas.

A pulsed electrodeless illuminator is described in U.S. Pat. No. 3,648,100 issued Mar. 7, 1972 to Goldie et al. and methods are taught for achieving rapid turn-on and turn-off characteristics. A source of beta radiations, such as 0.1 microcuries of cobalt 60 or 0.3 microcuries of heavy hydrogen, internal to the lamp envelope is utilized. It is stated that the electric field acts directly on the beta particles and increases their energy until ionization of the gas occurs. use of radioactive emissions other than beta particles is not described. A beta particle emitter was used to promote rapid breakdown of the gas in a discharge device in U.S. Pat. No. 3,705,319 issued Dec. 5, 1972 to Goldie et al. Tritium, a beta emitter, was absorbed in titanium or yttrium and was separated from the discharge volume by a thin deposit of silicon dioxide.

In addition to the above-described patents, the following United States Patents, which may be of interest, relate to electrodeless lamps, usually at least one of the patentees of each patent is an applicant of this application, and all patents have been assigned to a common assignee.

| U.S. Pat. No. | Patentee | Issue Date |
|---|---|---|
| 3,942,058 | Haugsjaa et al. | March 2, 1976 |

-continued

| U.S. Pat. No. | Patentee | Issue Date |
|---|---|---|
| 3,942,068 | Haugsjaa et al. | March 2, 1976 |
| 3,943,401 | Haugsjaa et al. | March 9, 1976 |
| 3,943,402 | Haugsjaa et al. | March 9, 1976 |
| 3,943,403 | Haugsjaa et al. | March 9, 1976 |
| 3,943,404 | McNeill et al. | March 9, 1976 |
| 3,993,927 | Haugsjaa et al. | November 23, 1976 |
| 3,995,195 | Haugsjaa et al. | November 30, 1976 |
| 4,001,631 | McNeill et al. | January 4, 1977 |
| 4,001,632 | Haugsjaa et al. | January 4, 1977 |
| 4,002,943 | Regan et al. | January 11, 1977 |
| 4,065,701 | Haugsjaa et al. | December 27, 1977 |
| 4,070,603 | Regan et al. | January 24, 1978 |

Also of interest is the following United States Patent which relates to electrodeless lamps. 3,787,705 Bolin et al. Jan. 22, 1974

Prior Art Statement

The United States Patents set forth hereinabove constitute prior art which includes, in the opinion of the applicants and their attorney, the closest prior art of which they are aware. This prior art statement shall not be construed as a representation that a search has been made or that no better art exists.

SUMMARY OF THE INVENTION

It is an object of the present invention to provide new and improved electrodeless lamps.

It is another object of the present invention to provide starting aids for electrodeless light sources in the form of radioactive materials associated with the light source.

It is another object of the present invention to provide reliable starting and restarting of electrodeless light sources.

It is another object of the present invention to provide simple, low costs starting aids for electrodeless light sources.

According to one aspect of the invention, these and other objects and advantages are achieved in an electrodeless lamp for use in an electromagnetic discharge apparatus. The electrodeless lamp includes a lamp envelope made of a light transmitting substance enclosing a fill material which emits light during discharge. Associated with the electrodeless lamp is a radioactive material having a half-life sufficient to produce radioactive emissions during the useful life of said electrodeless lamp and producing radioactive emissions with sufficient energy to reach the inner surface of the lamp envelope. The radioactive emissions are operative to predispose on the inner surface of the lamp envelope loosely bound charges which thereafter assist in initiating discharge.

according to another aspect of the invention, the above-stated and other objects and advantages are achieved in an electromagnetic discharge apparatus. The apparatus includes electrodeless lamp means having a lamp envelope made of a light transmitting substance enclosing a fill material which emits light during electromagnetic discharge. The apparatus further includes means for excitation of said fill material coupled to said electrodeless lamp means and adapted for delivering high frequency power to said lamp means for sustaining said electromagnetic discharge. Associated with the electromagnetic discharge apparatus is a radioactive material having a half-life sufficient to produce radioactive emissions during the useful life of said apparatus and producing radioactive emissions with sufficient energy to reach the inner surface of the lamp envelope. The radioactive emissions are operative to predispose on the inner surface of said lamp envelope loosely bound charges which thereafter assist in initiating discharge.

DESCRIPTION OF THE PREFERRED EMBODIMENTS

For a better understanding of the present invention, together with other and further objects, advantages and capabilities thereof, reference is made to the following disclosure and appended claims in connection with the above-described drawings.

Figure 1:
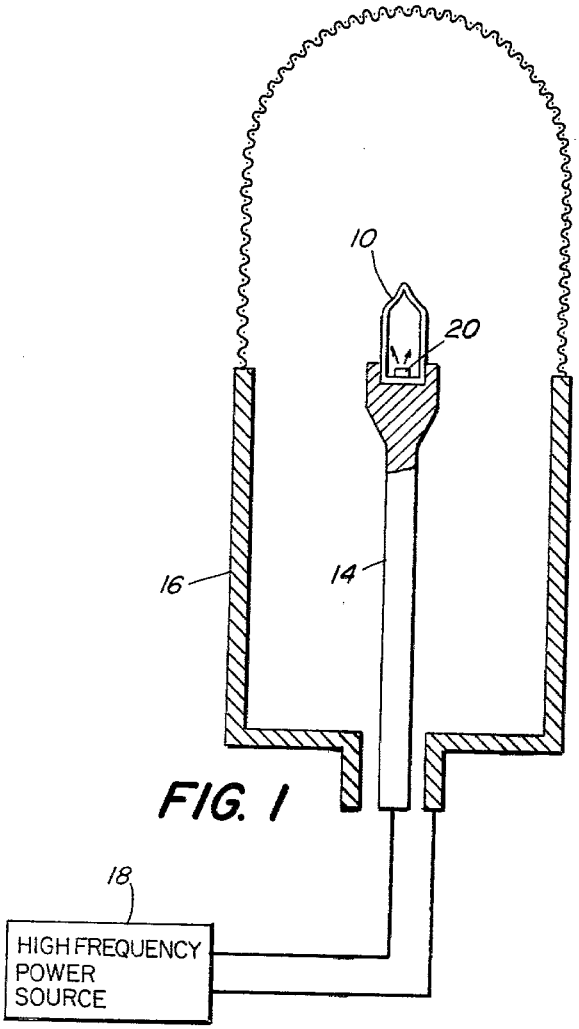
FIG. 1 is a sectional view of an electrodeless light source according to the present invention.

An electromagnetic discharge apparatus is shown in FIG. 1 as an electrodeless light source. The light source includes an electrodeless lamp 10 made of a light transmitting substance, such as quartz, enclosing a fill material which emits light upon breakdown and excitation. The fill material is typically composed of mixtures of mercury, sodium iodide, and scandium iodide in a background inert gas such as neon, argon, or krypton. The electrodeless light source also includes a means for excitation of the fill material which is coupled to the electrodeless lamp 10. The means for excitation is normally a termination fixture in which a transmission line is adapted for delivering high frequency power to the electrodeless lamp so that said lamp forms a termination load for high frequency power propagating along the transmission line. The excitation means can include a high frequency power source. The means for excitation is shown in FIG. 1 as a termination fixture 12 which has an inner conductor 14 and an outer conductor 16 disposed around the inner conductor 14. The fixture 12 typically has a coaxial configuration. The conductors have a first end coupled to a high frequency power source 18 and a second end coupled to the electrodeless lamp 10. The power source 18 can be connected by coaxial cable to the termination fixture 12 or can be an integral part of the electromagnetic discharge apparatus. In the latter situation, the power source 18 is built into the base of the apparatus. Termination fixture configurations wherein the electrodeless lamp is easily replaceable are useful if the life of the lamp is shorter than the life of the high frequency power source. The high frequency power source 18 produces in the electrodeless lamp 10 a high frequency electric field. The frequency of operation is in the range from 100 MHz to 300 GHz and typically in the ISM (Industrial, Scientific and Medical) band between 902 MHz and 928 MHz. One preferred operating frequency is 915 MHz. Construction of the termination fixture is described in more detail in U.S. Pat. No. 3,942,058 issued Mar. 2, 1976 to Haugsjaa et al. Impedance matching considerations are described in U.S. Pat. No. 3,943,403 issued Mar. 9, 1976 to Haugsjaa et al. A high frequency power source is described in U.S. Pat. No. 4,070,603 issued Jan. 24, 1978 to Regan et al. Referring again to FIG. 1, the electrodeless lamp 10 contains a non-gaseous radioactive material 20 according to a preferred embodiment of the present invention. The purpose of the radioactive material is to assist in initiating discharge within the electrodeless lamp 10.

The most common emissions from radioactive material are alpha particles, beta particles, and gamma rays, each of which has different properties as hereinabove described. A typical electrodeless lamp envelope of the type described above has internal dimensions about one centimeter and contains gas at a pressure substantially below one atmosphere when it is desired to initiate a discharge therein. Lamp envelope thickness is typically 0.1 centimeter. Thus, all of the above radioactive emissions will be preferentially absorbed in the lamp envelope materials. Only gamma rays are capable of penetration of the lamp envelope material and may therefore be utilized internally or externally to the lamp with similar effect. Alpha particles and beta particles, to be effective, must be contained within the enclosed volume of the lamp or within the lamp envelope material.

The effect of the alpha particles, beta particles, or gamma rays is to provide ionization, molecular excitation and release of loosely bound electronic charge on the inner surface of the lamp envelope material. A smaller number of ionizations occurs within the gaseous portion of the lamp fill material. The high frequency electric field in the termination fixture has negligible direct effect on alpha and beta particles and no effect on gamma rays. The activation of the internal surfaces provides an easily detached reservoir of charges to be accelerated by the high frequency electric field employed to drive the electrodeless lamp. The fact that the high frequency electric field does not act directly upon the radioactive emissions can be understood from consideration of the extremely short transit time of alpha and beta particles within the lamp volume and the fact that their energy greatly exceeds that which can be produced by the applied field prior to the absorption of the particles in the lamp envelope. Gamma radiation is not affected by the field because of its photonic nature.

The deposition of energy in the lamp envelope and, in particular, on the inner surface of the lamp envelope, produces an integrating effect since secondary charges will be multiple in number and will persist for long periods relative to the primary particle or photon involved. The integrating effect lessens the number of primary particles required for the creation of relatively easy lamp starting conditions as compared with that needed in known discharge devices requiring rapid (microsecond) starting time. The existence of an integrating or accumulation process on the inner surface of the lamp envelope, together with the relatively slow (on the order of a few seconds) start requirements of electrodeless light sources, permits the use of extremely low levels of radioactivity. Because of the continuous effect of the radioactive emissions, sufficient loosely bound charges to assist in lamp starting are present on the inner surface of the lamp envelope at the time when high frequency power is applied. The loosely bound charges are easily detached and accelerated by the high frequency electric field to cause collisional ionization and breakdown and to initiate discharge within the lamp.

There are several criteria for the choice of specific radioactive materials to be used in accordance with the present invention. The half-life of the radioactive material is an important factor to be considered in choosing specific radioactive materials. The half-life, which is the time for half the nucleii in a radioactive material to undergo radioactive decay, must be of the same order of magnitude or longer than the useful life of the electrodeless lamp. If the radioactive material is located in the termination fixture, its half-life must be of the same order of magnitude or longer than the useful life of the termination fixture. The radioactive material continues to produce radiation whether or not the light source is being operated. Therefore, "useful life" as used in this context includes not only light source operating time but also maximum expected storage time by manufacturers, wholesalers, retailers, and end users. One simple rule is to select a radioactive material with half-life equal to or longer than the useful life of the lamp. However, this does not rule out the use of materials with half-lives slightly less than the useful life of the lamp since the material continues to undergo radioactive decay and produce radiation after one half-life has passed. It would be expected that most applications would require the radioactive material to have a half-life in excess of one year. On the other hand, radioactive materials with very long half-lives are impractical for use in electrodeless light sources because large quantities of the material are required for a given activity level.

Radioactive materials used within the lamp envelope are required to be chemically compatible with the lamp fill material and with the lamp envelope material so that reactions don't generate impurities within the lamp envelope. For example, radioactive isotopes of the standard lamp fill material would be suitable. If the radioactive material is to be enclosed within the lamp envelope, it must be a material which can be contained by the envelope material. For example, tritium passes relatively easily through hot quartz. Moreover, the penetration depth and particle energy of the radioactive emissions must be taken into account. Penetration depth, which is the distance a particle travels in a given material before its energy is dissipated, depends on the type of particle and on the particle energy and is important in determining where a given radioactive material can be located in the electrodeless light source. Based on the penetration depths given previously for the various particles, gamma ray emitters are required if the radioactive material is located outside the lamp envelope. Gamma ray, alpha particle, or beta particle emitters can be utilized inside the lamp envelope. The particle energy determines the number of ionizations produced per particle emitted. However, the number of ionizations produced is of lesser importance since many ionizations are caused even by radioactive emissions with relatively low energy. The more important consideration is insuring that the particle energy is not dissipated before the particle reaches the interior of the lamp by proper selection of penetration depth. Finally, the activity level of the radioactive material is a consideration. Because of the accumulation effect of the charges on the inner surface of the lamp envelope, very low activity levels achieve the desired effect. It has been determined that activity levels as low as 0.01 microcurie are effective as lamp starting aids. When radioactive materials are placed inside the lamp envelope, 0.005 microcurie has been found sufficient to assist lamp starting. Such levels are considered entirely safe and are well below allowable government radiation level standards for use in the home.

Figure 2:
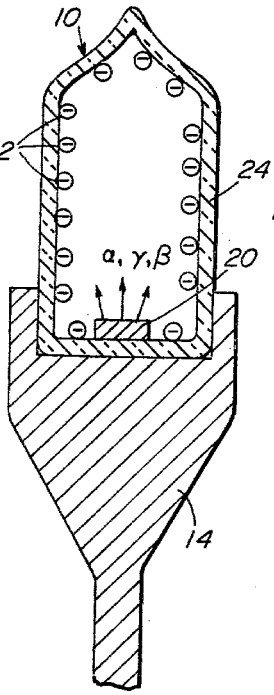
FIG. 2 is a partial sectional view of an electrodeless lamp and inner conductor with non-gaseous fill material enclosed within the lamp envelope.

The electrodeless lamp and part of the inner conductor in the preferred embodiment shown in FIG. 1 are illustrated in an enlarged view in FIG. 2. The radioactive material 20 is located inside the lamp envelope 24 and is a solid or liquid. The radioactive material 20 is a source of one or more of the radioactive emissions taken from the group consisting of alpha particles, beta particles, and gamma rays, as illustrated in FIG. 2. Preferably, the radioactive material is an isotope of the normal lamp fill materials. Considering the typical fill materials given above, iodine 129, a beta and gamma emitter with a half-life of $1.7\times10^7$ years, is a suitable radioactive isotope. The only useful isotope of mercury, Hg 203, has a half-life of only 47 days which is too short for use in a light source. Neither sodium nor scandium possess radioactive isotopes which have sufficiently long half-lives to be practical in the present invention.

Radioactive materials other than isotopes of the normal fill materials can be used provided they are chemically compatible with said fill materials. Examples of materials which can be used are listed in the following table. Also listed are the type of radioactive emission and the half-life of each radioactive material.

| Radioactive Material | | Emission | Half-Life in Years |
|---|---|---|---|
| nickel | 63 | beta | 92 |
| cesium | 137 | beta | 30 |
| antimony | 125 | beta, gamma | 2.7 |
| holmium | 166 | beta | 1200 |
| thulium | 171 | beta | 1.9 |
| thallium | 204 | beta, gamma | 3.8 |
| thorium | 228 | alpha, gamma | 1.9 |
| americium | 241 | alpha, gamma | 460 |
| cadmium | 113 | beta, gamma | 14 |

The emissions from the radioactive material 20, for example, alpha particles and gamma rays in the case of americium 241, are operative to predispose loosely bound charges 22 on the inner surface of the lamp envelope 24. The level of activity required is much less than 0.1 microcurie, typically 0.005 microcurie.

Figure 3:
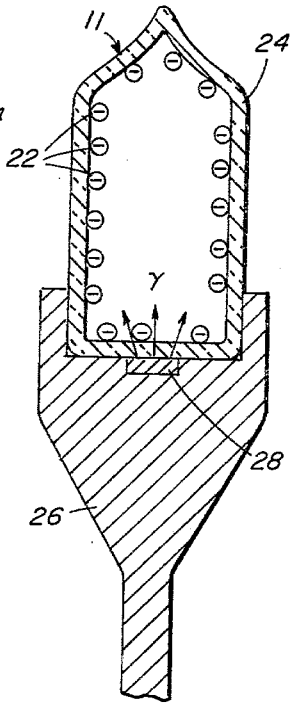
FIG. 3 is a partial sectional view of an electrodeless lamp and inner conductor with radioactive material located in the termination fixture.

According to another preferred embodiment of the present invention, the radioactive material is incorporated into the termination fixture. Referring now to FIG. 3, there is shown an electrodeless lamp 11 and part of the inner conductor 26 with a pellet of radioactive material 28 located at the end of the inner conductor 26 directly below the electrodeless lamp 11. The radioactive emissions, shown in FIG. 3 as gamma rays, from the radioactive material 28 are operative to predispose loosely bound charges 22 on the inner surface of the lamp envelope 24. Since the radioactive emissions must penetrate the lamp envelope material, only gamma ray emitters are suitable for use in the termination fixture. Essentially all alpha particles and beta particles would be absorbed and attenuated by the lamp envelope material. The use of a gamma ray source which is part of the termination fixture is useful when it is undesirable for economic reasons or disposal restrictions to charge the electrodeless lamp with a radioactive material. This may be the case when the use mode results in a relatively short lamp life. An additional advantage is the freedom to choose any reasonable mass of material needed to obtain a given activity level because of the larger dimensions of the termination fixture. The materials listed in the above table as gamma ray emitters, antimony 125, thallium 204, thorium 228, cadmium 113, and americium 241, and also iodine 129, are examples of gamma ray emitters which are suitable for location in the termination fixture. Americium 241 is a particularly useful radioactive material since it is commonly used in commercial products such as smoke detectors and is thus available in convenient form and useful activity level. Required activity levels are much less than 0.1 microcurie and typically about 0.01 microcurie. Laboratory experiments have shown that americium 241 functions as an effective starting and restarting aid in electrodeless light sources. It should be obvious to those skilled in the art that the radioactive material can be disposed in the termination fixture in various forms and locations without departing from the scope of the present invention. For example, the radioactive material can be dispersed in the inner conductor material rather than taking the form of a pellet. Alternatively, the radioactive material can be located in the outer conductor.

Figure 4:
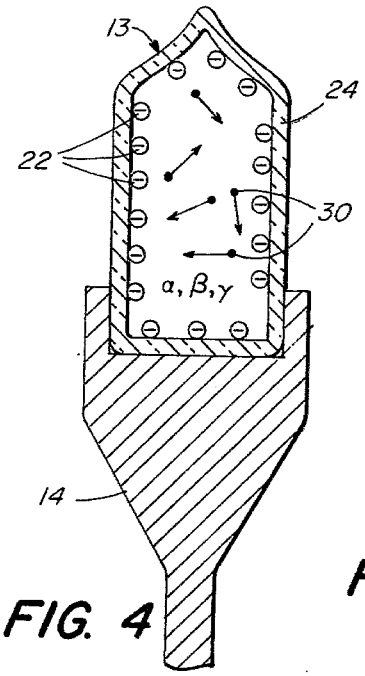
FIG. 4 is a partial sectional view of an electrodeless lamp and inner conductor with gaseous radioactive fill material enclosed within the lamp envelope.
Figure 5:
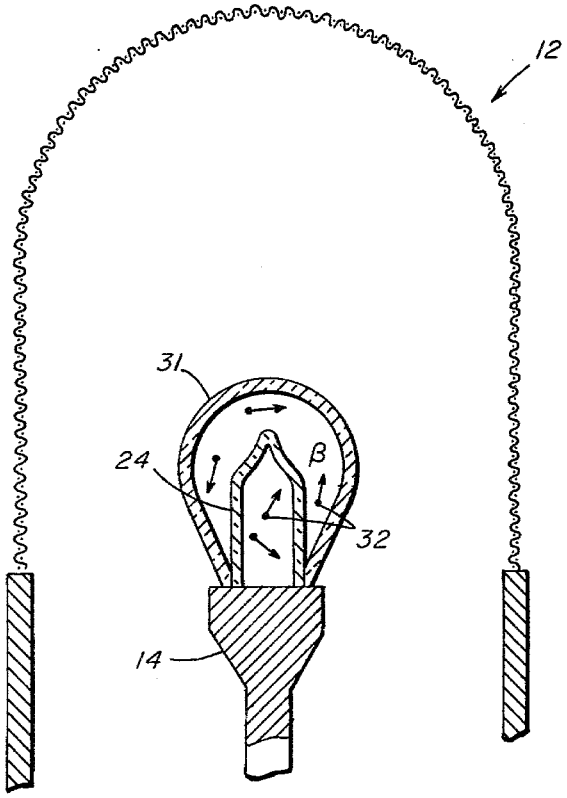
FIG. 5 is a partial sectional view of a double envelope system and inner conductor with tritium 3 as the radioactive material.

Another preferred embodiment of the present invention is shown in FIG. 4. An electrodeless lamp 13 and part of the inner conductive 14 is shown with a gaseous radioactive material 30 enclosed within the lamp envelope 24. The radioactive emissions from the radioactive material 30 are operative to predispose loosely bound charges 22 on the inner surface of the lamp envelope 24. Alpha particle, beta particle and gamma ray emitters, as illustrated in FIG. 4, are all useful as the gaseous radioactive material 30 to be enclosed within the lamp envelope 24. It is particularly useful to utilize a noble gas for this purpose since such gases are normally required at pressures of 1 to 20 Torr as the initial discharge medium in the electrodeless lamp 13. Based on half-life and other considerations, krypton 85 is useful as a starting aid. Krypton 85 emits a beta particle and a gamma ray with a half-life of about eleven years. The gas is available with a specific activity of about 20 Curie/gm. Since activity levels much less than 0.1 microcurie are effective in creating easy-to-start conditions in electrodeless lamps, gas mixtures have successfully been used typically containing 99% argon, the normal fill gas, and 1% krypton. Other gases may be used, provided certain criteria with regard to containment and electrical discharge characteristics are met. Tritium 3 emits a beta particle with a half-life of twelve years. However, its molecular nature tends to inhibit break-down and it is not contained permanently in many glass envelopes especially those made of quartz. One way to use tritium 3 as a starting aid while avoiding the above problems is to utilize a double envelope system as shown in FIG. 5. The double envelope system has a lamp envelope 24 and an outer envelope 31 and is coupled to the inner conductor 14. The lamp envelope 24 is quartz as previously described, contains the lamp fill material other than tritium 3, and is the discharge vessel. The outer envelope 31 is glass of a type not permeable to hydrogen or hydrogen isotopes. It is typically a multi-component glass such as Pyrex which is a borosilicate glass.

Tritium 3, illustrated as 32, is contained by the outer envelope 31 and is also present inside the lamp envelope 24 since the lamp envelope 24 is permeable to tritium 3. The lamp envelope 24 is necessary to withstand the temperatures produced during discharge.

Figure 6:
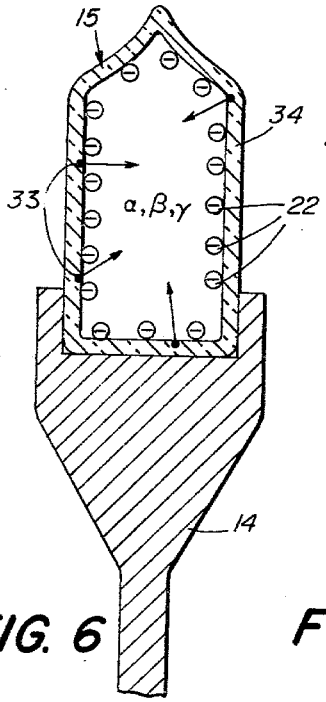
FIG. 6 is a partial sectional view of an electrodeless lamp and inner conductor with radioactive material dispersed in the lamp envelope material.

Yet another embodiment of the present invention is shown in FIG. 6. An electrodeless lamp 15 and part of the inner conductor 14 is shown with a radioactive material 33 dispersed in the material of the lamp envelope 34. The radioactive emissions, shown in FIG. 6 as alpha particles, beta particles, or gamma rays from the radioactive material 33 are operative to predispose loosely bound charges 22 on the inner surface of the lamp envelope 34. If the radioactive material is substantially uniformly disposed in the lamp envelope 34 material, alpha particles, beta particles and gamma rays are all useful as lamp starting aids. Alpha particles and beta particles are less efficient when the radioactive material is dispersed in the envelope material because particles originating near the outer surface of the lamp envelope 34 are absorbed before reaching the inner surface. Only those alpha and beta particles originating near the inner surface of the lamp envelope 34 are effective in penetrating to the interior of the lamp. Gamma ray sources are more effective because of the greater penetration depth of gamma rays. The radioactive material can be dispersed in the lamp envelope material by a variety of methods including mechanical mixing in the molten state, beam implantation, and chemical reaction. An example of chemical reaction is uranium glass, known by Corning code 3320, which contains 1.8% by weight of $U_3O_8$. One gram of such glass exhibits an activity level of about $10^{-8}$ Curie when the isotopes of uranium are present in their naturally occurring quantity.

Figure 7:
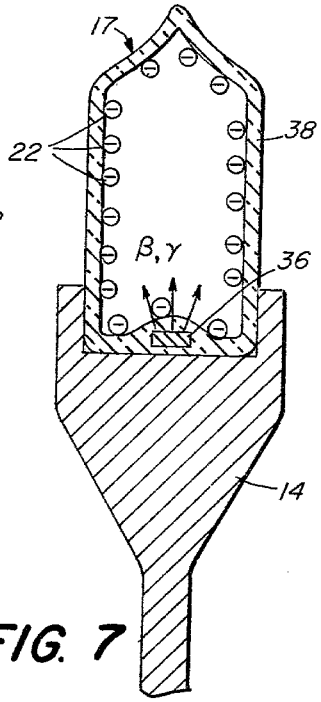
FIG. 7 is a partial sectional view of an electrodeless lamp and inner conductor with radioactive material imbedded within the lamp envelope material.

Yet another embodiment of the present invention is shown in FIG. 7. An electrodeless lamp 17 and part of the inner conductor 14 is shown with radioactive material 36 imbedded in the material of the lamp envelope 38. The radioactive emissions, shown in FIG. 7 as gamma rays, or beta particles from the radioactive material 36 are operative to predispose loosely bound charges 22 on the inner surface of the lamp envelope 38. In this instance, the radioactive material 36 is concentrated at one or more locations in the lamp envelope 38 material rather than being dispersed uniformly throughout the lamp envelope 38 and can take the form of a pellet. Gamma ray emitters are most useful as lamp starting aids when the radioactive material is imbedded in the lamp envelope since gamma rays penetrate the lamp envelope material effectively. Alpha particles do not penetrate the envelope material which surrounds the radioactive material and are therefore ineffective in the present embodiment. Beta particles are only partially effective and only a percentage of the particles emitted penetrate to the interior of the lamp envelope 36. Gamma ray emitters such as antimony 125, thallium 204, thorium 228, cadmium 113, iodine 129, and americium 241 are examples of radioactive materials suitable for use in the present embodiment of the invention.

While there has been shown and described what is at present considered the preferred embodiments of the invention, it will be obvious to those skilled in the art that various changes and modifications may be made therein without departing from the scope of the invention as defined by the appended claims.

What is claimed is:

1. An electrodeless lamp for use in an electromagnetic discharge apparatus, the electrodeless lamp comprising:

a lamp envelope made of a light transmitting substance and having an inner surface;

a fill material, which emits light during electromagnetic discharge, enclosed by said lamp envelope; and a radioactive material associated with said electrodeless lamp and selected from the group consisting of iodine 129, nickel 63, cesium 137, antimony 125, holmium 166, thulium 171, thallium 204, thorium 228, cadmium 113, and americium 241, said radioactive material having a half-life sufficient to produce radioactive emissions during the useful life of said electrodeless lamp and producing radioactive emission with sufficient energy to reach the inner surface of said lamp envelope, said radioactive emissions being operative to predispose on the inner surface of said lamp envelope loosely bound charges which thereafter assist in initiating discharge.

2. The electrodeless lamp as defined in claim 1 wherein said radioactive material is enclosed within said lamp envelope and is chemically compatible with said fill material.

3. The electrodeless lamp as defined in claim 1 wherein said radioactive material has an activity level of about $10^{-8}$ curie.

4. The electromagnetic discharge apparatus as defined in claim 1 wherein said fill material includes mercury, sodium iodide, scandium iodide, and an inert gas.

5. An electromagnetic discharge apparatus comprising;

electrodeless lamp means having a lamp envelope made of a light transmitting substance, said envelope having an inner surface and enclosing a fill material which emits light during electromagnetic discharge;

means coupled to said electrodeless lamp means for excitation of said fill material and adapted for delivering high frequency power to said lamp means for sustaining said electromagnetic discharge; and a radioactive material associated with said discharge apparatus and selected from the group consisting of iodine 129, nickel 63, cesium 137, antimony 125, holmium 166, thulium 171, thallium 204, thorium 228, cadmium 113, and americium 241, said radioactive material having a half-life sufficient to produce radioactive emissions during the useful life of said discharge apparatus and producing radioactive emissions with sufficient energy to reach the inner surface of said lamp envelope, said radioactive emissions being operative to predispose on the inner surface of said lamp envelope loosely bound charges which thereafter assist in initiating discharge.

6. The electromagnetic discharge apparatus as defined in claim 5 wherein said means for excitation of said fill material includes transmission line means having a first end for receiving high frequency power and a second end coupled to said lamp means so that said lamp means forms a termination load for high frequency power propagating along said transmission line means.

7. The electromagnetic discharge apparatus as defined in claim 6 wherein said means for excitation of said fill material further includes high frequency power means coupled to the first end of said transmission line means.

8. The electromagnetic discharge apparatus as defined in claim 7 wherein said transmission line means includes a termination fixture having an inner conductor and an outer conductor disposed around the inner conductor.

9. The electromagnetic discharge apparatus as defined in claim 8 wherein said fill material includes mercury, sodium iodide, scandium iodide, and an inert gas.

10. The electromagnetic discharge apparatus as defined in claim 7 wherein said radioactive material is enclosed within said lamp envelope and is chemically compatible with said fill material.

11. The electromagnetic discharge apparatus as defined in claim 10 wherein said radioactive material has an activity level of about $10^{-8}$ curie.

12. An electromagnetic discharge apparatus comprising:

electrodeless lamp means having a lamp envelope made of a light transmitting substance, said envelope having an inner surface and enclosing a fill material which emits light during electromagnetic discharge;

means coupled to said electrodeless lamp means for excitation of said fill material and adapted for delivering high frequency power to said lamp means for sustaining said electromagnetic discharge; and a radioactive material outside said envelope and associated with said excitation means, said radioactive material having a half-life sufficient to produce radioactive emissions during the useful life of said discharge apparatus and producing radioactive emissions with sufficient energy to reach the inner surface of said lamp envelope, said radioactive emissions including gamma rays and being operative to predispose on the inner surface of said lamp envelope loosely bound charges which thereafter assist in initiating discharge.

13. The electromagnetic discharge apparatus as defined in claim 12 wherein said means for excitation of said fill material includes transmission line means having a first end for receiving high frequency power and a second end coupled to said lamp means so that said lamp means forms a termination load for high frequency power propagating along said transmission line means.

14. The electromagnetic discharge apparatus as defined in claim 13 wherein said means for excitation of said fill material further includes high frequency power means coupled to the first end of said transmission line means.

15. The electromagnetic discharge apparatus as defined in claim 14 wherein said transmission line means includes a termination fixture having an inner conductor and an outer conductor disposed around the inner conductor.

16. The electromagnetic discharge apparatus as defined in claim 15 wherein said radioactive material is located at the second end of said inner connector.

17. The electromagnetic discharge apparatus as defined in claim 16 wherein said radioactive material includes material selected from the group consisting of americium 241, antimony 125, thallium 204, thorium 228, cadmium 113, and iodine 129.

18. The electromagnetic discharge apparatus as defined in claim 17 wherein said radioactive material has an activity level of about $10^{-8}$ curie.

19. The electromagnetic discharge apparatus as defined in claim 15 wherein said fill material includes mercury, sodium iodide, scandium iodide, and an inert gas.

* * * * *